US005183450A

United States Patent [19]

Stelmach

[11] Patent Number: 5,183,450

[45] Date of Patent: Feb. 2, 1993

[54] MARTIAL ARTS TRAINING APPARATUS

[76] Inventor: John J. Stelmach, 1607½ Idylwild, Prescott, Ariz. 86301

[21] Appl. No.: 802,507

[22] Filed: Dec. 5, 1991

[51] Int. Cl.[5] ..... A63B 69/00

[52] U.S. Cl. ..... 482/83; 482/86; 273/55 A

[58] Field of Search ..... 272/76, 77, 78; 482/83-89; 273/55 A, 55 R

[56] References Cited

U.S. PATENT DOCUMENTS

| | | | |
|---|---|---|---|
| 658,554 | 9/1900 | McFadden . | |
| 1,267,678 | 5/1918 | McArdle . | |
| 1,906,693 | 3/1932 | Loughlin | 273/55 A |
| 2,826,416 | 7/1955 | Heffner | 482/86 |
| 3,421,759 | 1/1969 | Chambers . | |
| 3,724,845 | 4/1973 | Irby . | |
| 4,077,624 | 3/1978 | Feaser . | |
| 4,084,811 | 4/1978 | Kyo . | |
| 4,309,029 | 1/1982 | Tomko . | |
| 4,557,477 | 12/1985 | Clements | 482/86 |
| 4,635,929 | 1/1987 | Shustack . | |
| 4,702,472 | 10/1987 | Anquetil . | |
| 4,807,871 | 2/1989 | Bryson . | |
| 4,836,533 | 6/1989 | Dong . | |
| 4,932,652 | 6/1990 | Beall . | |
| 4,946,159 | 8/1990 | Jones . | |

OTHER PUBLICATIONS

Black Belt Magazine, Jul. 1987 p. 87, Weighted Foam Bag, Universal Bag Stand and Single Bag Anchor.

*Primary Examiner*—Richard J. Apley
*Assistant Examiner*—Jerome Donnelly
*Attorney, Agent, or Firm*—Richard G. Harrer; Charles E. Cates

[57] ABSTRACT

A martial arts training apparatus which includes a generally cylindrical shaped heavy bag having opposed ends and provided with means at its upper end for suspending the bag, and a simulated human leg which is positioned immediately adjacent the lower end of the heavy bag, with the simulated leg being generally cylindrical in shape and of a size which substantially replicates a human leg and is deformable. The simulated leg is secured to a frame means for properly positioning and suspending it from the heavy bag, with the frame means being positioned at the lower end of the heavy bag and external to the bag and shaped so as to conform to the shape of the lower end of the heavy bag. Means are also included for suspending and securing the frame means and the simulated leg to the heavy bag.

3 Claims, 1 Drawing Sheet

MARTIAL ARTS TRAINING APPARATUS

FIELD OF THE INVENTION

This invention relates to the field of martial arts and particularly to an apparatus useful as a training dummy in the execution of martial arts techniques and particularly the execution of the low kick and even more particularly to an apparatus simulating the human leg and its response to a well executed low kick.

BACKGROUND OF THE INVENTION

The martial arts are usually considered to include any of several oriental arts of combat or self defense such as karate, judo or tae kwon do which are usually practiced as a sport. A facet in the field of martial arts is kick boxing or low kicks with the foot. That is, a low kick by the martial artist is delivered to the leg of an opponent, customarily the forward leg. The purpose is primarily defensive, that is, to deliver a blow to an opponent which will discourage further attack. Since a properly executed blow can cause severe and even permanent damage to the opponent's leg, it is important in practicing the techniques involved that a simulated human leg be used to avoid injury.

Numerous devices have been developed for use in martial arts training and even specifically designed to use in training in the use of the low kick. For example, U.S. Pat. No. 4,932,652 discloses an apparatus which ostensibly resembles in movement and function a human leg, particularly in response to a low kick. A simulated leg is mounted to a base and the simulated leg components comprise a lower and upper leg which are mounted to a suitable frame work. According to the disclosure in the patent, a properly executed low kick causes a collapse of the leg, that is, the two sections of the leg bend. U.S. Pat. No. 4,702,472 discloses a training dummy for combat sports which has a head and chest portions secured to a frame. The dummy can also be equipped with articulated and weighted limbs as shown in FIG. 2 of the patent. A still further example of martial arts training apparatus is shown in U.S. Pat. No. 4,309,029, the device or apparatus allegedly useful for practicing defensive strokes such as punching, striking and kicking. The apparatus includes a base, two arc supports of differing heights, which are resiliently attached in a vertical plane to the base with striking areas supported on the side of the arc supports. McArdle U.S. Pat. No. 1,267,678 discloses a practice dummy for boxers which utilizes two striking bags, an upper bag designed to represent the human head and then the lower bag to represent the human body. The entire two bag assembly is suspended from overhead and can also be tethered to the ground by means of a spring assembly. The bags are mounted so that they are in a sense "flexible" in that the upper bag, which represents the head, is designed to take the impact of "upper cut" blows. This apparatus is designed primarily for the use of boxers and probably has little or no relevance in the training in the use of the low kick.

SUMMARY OF THE INVENTION

The present invention is an apparatus for use in the field of martial arts and more particularly for use in practicing and exercising the various self-defense techniques involved, such as the execution of the low kick. The apparatus includes a generally cylindrical shaped heavy bag or sometimes referred to as a punching bag which is well known as being used in the training of boxers, in combination with a second considerably smaller generally cylindrical shaped bag sized to simulate the human leg, this second bag being suspended from the lower portion of the heavy bag. Special means are provided to suspend the simulated leg portion of the apparatus from the bottom of the heavy bag, the means including a frame which surrounds a lower portion of the heavy bag, with the frame being further provided with straps which extend to the top of the heavy bag where they are engaged to fully support and properly position the simulated leg. The entire apparatus is mounted such that the simulated leg portion is near the ground or floor such as would be the leg of a standing human subject.

DESCRIPTION OF THE PREFERRED EMBODIMENT

Figure 1:
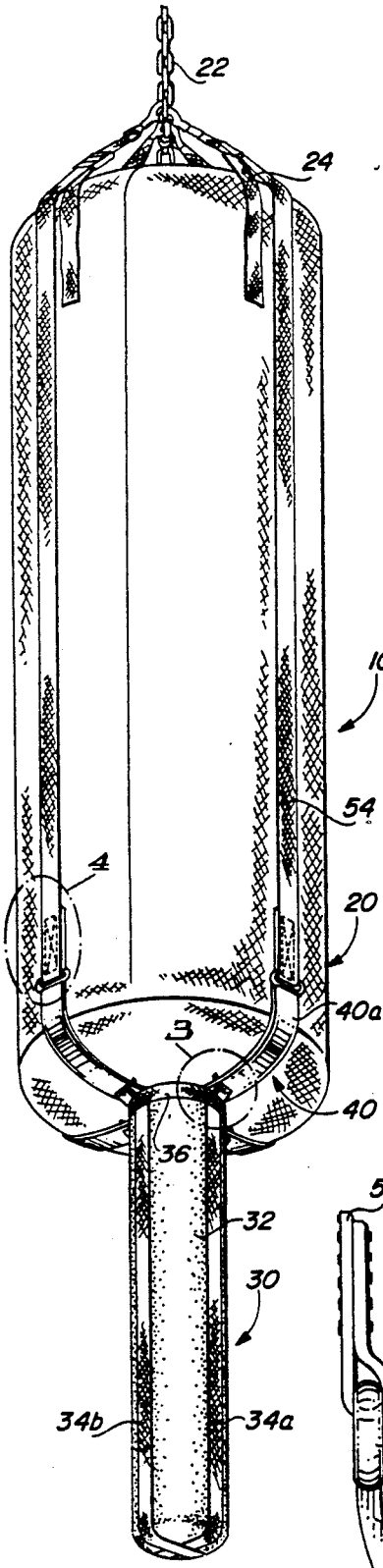
FIG. 1 is a perspective view of the martial arts training apparatus including heavy bag and simulated leg.

FIG. 1 is a perspective view of a preferred embodiment of the martial arts training apparatus which is shown generally at 10 and which includes a heavy bag 20, a simulated leg 30 and special means 40 to mount the simulated leg to the heavy bag. The heavy bag 20 is of the type that is customarily found in gymnasiums, usually about 1½ feet by 4 feet in size and weighing about 80 pounds. Such a bag is customarily used in practicing western style boxing. As shown the heavy bag is suspended from overhead by means of straps 24, one end of each of which are sewn to the exterior of the heavy bag and the other end to chain 22.

Positioned immediately below the heavy bag is the simulated leg shown generally at 30. The simulated leg is generally cylindrical in shape, about 22–24 inches in length and about 4–6 inches in diameter. The exterior 32 of leg 30 can be made from a durable flexible fabric such as canvas, which can be vinyl coated, the interior of the leg being filled with sand or other suitable material to replicate as nearly as possible the human leg. The lower end of simulated leg 30 can be provided with a tab **34*a*** so that the lower end of the simulated leg can be tethered to the floor to control movement, if desired.

In order to properly position and suspend the simulated leg from beneath the heavy bag, a pair of straps **34*a* and 34*b* are secured to the exterior of leg 30. As shown best in FIG. 1, strap 34*a* extends from the top portion of leg 30 down one side of the leg, across the bottom and then up to the opposite side of the leg. A portion of each end of strap 34*a* extends beyond the top portion of the leg to form a loop with passage 38. The same type of construction is employed with respect to strap 34*b* which results in four loops which are spaced at about 90 degrees about the circumference of leg 30 and which extend above the top of the leg. Each of straps 34*a* and 34*b* are secured to the exterior of the leg by means of stitching or other suitable means and a reinforcing strap 36** is sewn about the circumference of the top of the leg and over each of the vertically mounted straps to further ensure that the straps will not pull away from the leg during use.

Figure 2:
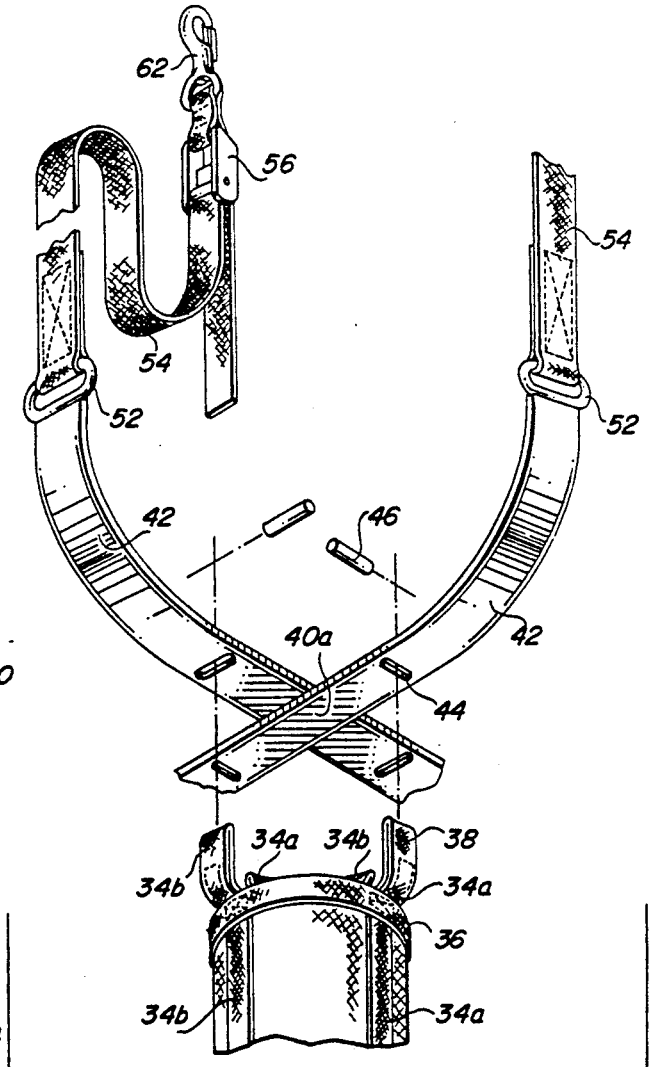
FIG. 2 is a partial perspective view showing in detail the means for securing the simulated leg to the heavy bag.
Figure 4:
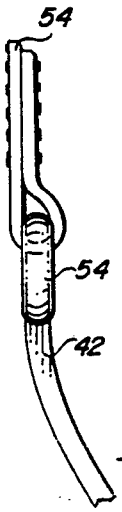
FIG. 4 is an enlargement of the area designated "4" of FIG. 1.

In order to obtain proper action from the simulated leg during use, a special frame means for positioning and suspending the leg from the bottom of heavy bag 20 is provided. Such means shown generally at 40 are illustrated in FIG. 1 and FIG. 2 and include a pair of bands 42, as shown. Each of the bands 42 is preferably formed of a rigid yet bendable material such as steel or aluminum and is generally U-shaped and are joined together at their respective centers at 40*b* by means of spot welding or other well-known fastening technique. Thus, the completed frame 40 is somewhat hemispherical in shape so that it conforms to the generally hemispherical shape of the lower end of heavy bag 20.

Figure 3:
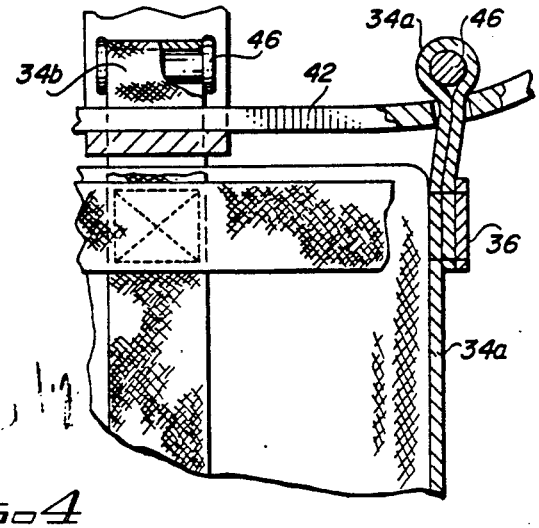
FIG. 3 is an enlargement of the area designated "3" of FIG. 1.

Simulated leg 30 is secured to frame 40 by inserting each of the free ends of straps 34*a* and 34*b* through slots 44 in the frame 40. As shown in greater detail in FIG. 3, after one of the free ends of strap 34*a*, for example, is inserted through slot 44, a pin 46 is inserted into passage 38 and this effectively serves to secure the one end of strap 34*a* to the frame. This operation is repeated with the remaining three free ends of the straps 34*a* and 34*b* and the simulated leg is then not only mounted to the frame but is centered thereon.

Construction of the apparatus is completed by properly mounting the simulated leg assembly to the heavy bag. As shown in FIG. 1 and FIG. 2, ring 52 is secured to each of the four free ends of frame members 40*a*. A strap 54 is secured to each of the rings, each of the straps 54 being of a length sufficient to extend from the frame along the length of the heavy bag. The free end of strap 54 is inserted through buckle 56 which allows the length of each strap to be readily lengthened or shortened. Attached to buckle 56 is snap hook 62 for attaching each of the straps to chain 22. After the snap hooks have been secured to the chain, then any slack in the straps is taken up by pulling on the free end of the straps so that frame assembly 40 and the simulated leg engages the bottom of the heavy bag.

It will be understood from the foregoing description that the martial arts training apparatus of this invention provides important advantages. Firstly, the apparatus utilizes in part a heavy bag or punching bag which is readily available at many gyms or health clubs. When the total apparatus is assembled, it of course is used to train persons in kick boxing or low kicks. Also, the heavy bag portion of the apparatus may still be used for practice by boxers with the simulated leg in position. Tests have shown that suspending the simulated leg from the heavy bag causes the heavy bag to move in a more unpredictable manner which can be a benefit in training a boxer. The heavy bag also provides a benefit to one training in kick boxing in that the length and weight of a typical heavy bag (about 80 pounds) mimicks the human torso and thus gives a more realistic feel to one using the apparatus in kick boxing training.

I claim:

1. Apparatus for use as a training dummy in the execution of martial arts techniques comprising a generally cylindrical shaped heavy bag having opposed ends and provided with means at a first end thereof for suspending said bag from overhead, a simulated human leg one end of which is positioned immediately adjacent the second end of said heavy bag and suspended therefrom, said simulated leg being generally cylindrical in shape and of a size which substantially replicates a human leg, the exterior surface of said simulated leg being deformable and said leg being filled with a material to substantially replicate the feel of a human leg, said leg being secured to a rigid frame means for properly positioning and suspending said simulated leg from said heavy bag, said frame means being positioned at said second end of said heavy bag and external to said bag and shaped so as to conform to the shape of said second end of said heavy bag, and means for suspending and securing said frame means and said simulated leg to said heavy bag.

2. The apparatus of claim 1 wherein said frame means includes a pair of rigid bands which are joined together at their centers.

3. The apparatus of claim 2 wherein said means for suspending said frame means and simulated leg comprises straps, one end of which are secured to an end of said bands with the other end of said straps being releasably secured to said means for suspending said heavy bag.

* * * * *